US012117180B2

(12) United States Patent
Johnson

(10) Patent No.: US 12,117,180 B2
(45) Date of Patent: Oct. 15, 2024

(54) OVEN APPLIANCE HAVING A MODULAR TRIM ASSEMBLY FOR COLLECTING DEBRIS

(71) Applicant: Haier US Appliance Solutions, Inc., Wilmington, DE (US)

(72) Inventor: Eric Scott Johnson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 493 days.

(21) Appl. No.: 17/482,872

(22) Filed: Sep. 23, 2021

(65) Prior Publication Data

US 2023/0092626 A1 Mar. 23, 2023

(51) Int. Cl.
*F24C 15/16* (2006.01)
*F24C 15/14* (2006.01)

(52) U.S. Cl.
CPC ..... *F24C 15/16* (2013.01); *F24C 15/14* (2013.01)

(58) Field of Classification Search
CPC ..... F24C 15/16; F24C 15/14
See application file for complete search history.

(56) References Cited

U.S. PATENT DOCUMENTS 3,211,082 A * 10/1965 Sachnoff ..... F24C 15/16 126/39 M
3,358,122 A 12/1967 Torrey
4,598,634 A * 7/1986 Van Horn, II ..... A47J 37/067 99/425
4,865,010 A 9/1989 Kett
5,695,668 A * 12/1997 Boddy ..... H05B 6/6476 219/486

(Continued)

FOREIGN PATENT DOCUMENTS

CN 204795645 U 11/2015
DE 4222323 A1 * 9/1993 ..... A47J 37/06

(Continued)

OTHER PUBLICATIONS

English Translation of DE4222323A1 via Espacenet, "Electric grill with ceramic glass grill plate—vhas fat catchment trough along one or more sides of grill plate to reduce cleaning frequency" Applicant: Schott Glaswerke, Inventors: Taplan Martin Dipl Ing [DE]; Hubert Stefan Dipl Ing [DE], Jun. 17, 1993 (Year: 1993).*

*Primary Examiner* — Alfred Basichas
(74) *Attorney, Agent, or Firm* — Dority & Manning, P.A.

(57) ABSTRACT

An oven appliance may include a cabinet, a plurality of chamber walls, a cooking plate, a debris trap, and a bottom heating element. The plurality of chamber walls may be mounted within the cabinet. The plurality of chamber walls may define an oven chamber. The plurality of chamber walls may include a back wall, a top wall, a first side wall, a second side wall, and a bottom wall. The cooking plate may define a cooking surface in the oven chamber between the bottom wall and the top wall. The debris trap may be disposed against the cooking plate. The debris trap may define a recessed trough horizontally spaced apart from the cooking surface and disposed therebelow. The bottom heating element may be mounted above the bottom wall to heat the cooking surface within the oven chamber.

20 Claims, 7 Drawing Sheets

(56) References Cited

U.S. PATENT DOCUMENTS

| | | | | |
|---|---|---|---|---|
| 5,981,914 | A * | 11/1999 | Schultheis | F24C 15/108 219/460.1 |
| 6,121,584 | A * | 9/2000 | Key | F24C 15/14 219/407 |
| 6,758,206 | B1 | 7/2004 | Barnes | |
| 6,987,252 | B2 | 1/2006 | Goodrich | |
| 7,342,203 | B2 * | 3/2008 | Benoit | F24C 7/06 219/402 |
| 7,378,617 | B1 | 5/2008 | Brockman | |
| 8,049,142 | B2 | 11/2011 | Blackson | |
| 9,782,039 | B2 * | 10/2017 | Ortner | A47J 37/067 |
| 10,012,392 | B2 | 7/2018 | Adelmann | |
| 10,082,297 | B2 | 9/2018 | Kim | |
| D833,207 | S * | 11/2018 | Zemel | D7/363 |
| 10,448,457 | B2 | 10/2019 | Armstrong | |
| 10,520,199 | B2 | 12/2019 | Polster | |
| 10,634,362 | B2 | 4/2020 | Vern | |
| 10,743,713 | B2 | 8/2020 | Battiston | |
| 2004/0149722 | A1 | 8/2004 | Dengler | |
| 2006/0081593 | A1 * | 4/2006 | Benoit | F24C 7/06 219/402 |
| 2008/0017348 | A1 * | 1/2008 | Criscuolo | F25D 25/028 165/59 |
| 2016/0123601 | A1 * | 5/2016 | Johnson | A47B 96/20 126/273 R |
| 2017/0089590 | A1 | 3/2017 | Bruin-Slot | |
| 2017/0130968 | A1 | 5/2017 | Nagraj | |
| 2018/0003390 | A1 * | 1/2018 | Trice | A21B 3/15 |
| 2019/0110641 | A1 * | 4/2019 | Lee | F24C 3/008 |
| 2019/0218028 | A1 * | 7/2019 | Akerberg | A47B 77/022 |
| 2023/0314005 | A1 * | 10/2023 | Lai | F24C 15/024 219/398 |

FOREIGN PATENT DOCUMENTS

| | | | | |
|---|---|---|---|---|
| DE | 10065213 | A1 * | 7/2002 | F24C 15/027 |
| DE | 102016224708 | A1 * | 6/2018 | |
| EP | 2251609 | B1 | 8/2017 | |
| JP | H07280281 | A | 10/1995 | |
| JP | 2010112664 | A | 5/2010 | |
| WO | WO2020048689 | A1 | 3/2020 | |

* cited by examiner

OVEN APPLIANCE HAVING A MODULAR TRIM ASSEMBLY FOR COLLECTING DEBRIS

FIELD OF THE INVENTION

The present subject matter relates generally to oven appliances, and more particularly, to heating assemblies of an oven appliance.

BACKGROUND OF THE INVENTION

Conventional residential and commercial oven appliances generally include a cabinet that includes a cooking chamber for receipt of food items for cooking. Multiple gas or electric heating elements are positioned within the cabinet for heating the cooking chamber to cook food items located therein. The heating elements can include, for example, a bake heating assembly positioned at a bottom of the cooking chamber and a separate broiler heating assembly positioned at a top of the cooking chamber.

Typically, food or utensils for cooking are placed on wire racks within the cooking chamber and above the bake heating assembly. In some instances, protective or radiant plates are positioned over the bake heating assembly to protect the bake heating assembly or assist in evenly distributing heat across the bottom of the cooking chamber. Oftentimes, the wire racks are at least mounted well above a bake heating assembly to ensure the bake heating assembly is not damaged or a user does not accidentally contact the bake heating assembly. When the bake heating assembly is activated, heat from the bake heating assembly is thus forced to rise through an air gap, and any other intermediate elements, between the bake heating assembly and the wire rack before the utensil on the wire rack can be heated. Heat is within the cooking chamber is relatively diffuse, and the temperature is generally consistent about the item or items on the rack. Moreover, debris, such as crumbs or other small particles, may fall through the wire racks or otherwise collect on a bottom wall of the cooking chamber, such as nearby or below the bake heating element.

Although these conventional configurations are useful for many types of foods, there are certain disadvantages. For instance, certain food items benefit from very high, localized (i.e., non-diffuse) heat. Oftentimes, stone or specialized high-heat pans are used for trapping heat against the bottom of flat-breads or pizza. Such pans may be difficult to preheat or maintain a specific temperature desired by the user. Although placing a pan closer to a heating element may help heat the pan faster or to a higher temperature, the pan may be difficult to secure or stabilize close to the heating element. High heat, in particular, may create difficulties in supporting or mounting any pan adjacent to a heating element. Moreover, none of these conventional designs address issues that arise with crumbs or particles at the bottom of the cooking chamber, which may be difficult to clean or remove.

Accordingly, it would be advantageous to provide an oven appliance capable of safely generating high heat on a specific and secure cooking surface. Additionally or alternatively, it may be useful to provide an assembly for readily collecting debris (e.g., away from a heating element).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an oven appliance is provided. The oven appliance may include a cabinet, a plurality of chamber walls, a cooking plate, a debris trap, and a bottom heating element. The plurality of chamber walls may be mounted within the cabinet. The plurality of chamber walls may define an oven chamber. The plurality of chamber walls may include a back wall, a top wall, a first side wall, a second side wall, and a bottom wall. The cooking plate may define a cooking surface in the oven chamber between the bottom wall and the top wall. The debris trap may be disposed against the cooking plate. The debris trap may define a recessed trough horizontally spaced apart from the cooking surface and disposed therebelow. The bottom heating element may be mounted above the bottom wall to heat the cooking surface within the oven chamber.

In another exemplary aspect of the present disclosure, an oven appliance is provided. The oven appliance may include a cabinet, a plurality of chamber walls, a cooking plate, a debris trap, and a bottom heating element. The plurality of chamber walls may be mounted within the cabinet. The plurality of chamber walls may define an oven chamber. The plurality of chamber walls may include a back wall, a top wall, a first side wall, a second side wall, and a bottom wall. The cooking plate may define a cooking surface in the oven chamber between the bottom wall and the top wall. The debris trap may be disposed against the cooking plate. The debris trap may define a recessed trough horizontally spaced apart from the cooking surface and disposed therebelow. The debris trap may further define an outer edge disposed above the cooking surface relative to a vertical direction. The debris trap may include an interior flange disposed beneath the cooking plate in support thereof. The bottom heating element may be mounted above the bottom wall to heat the cooking surface within the oven chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
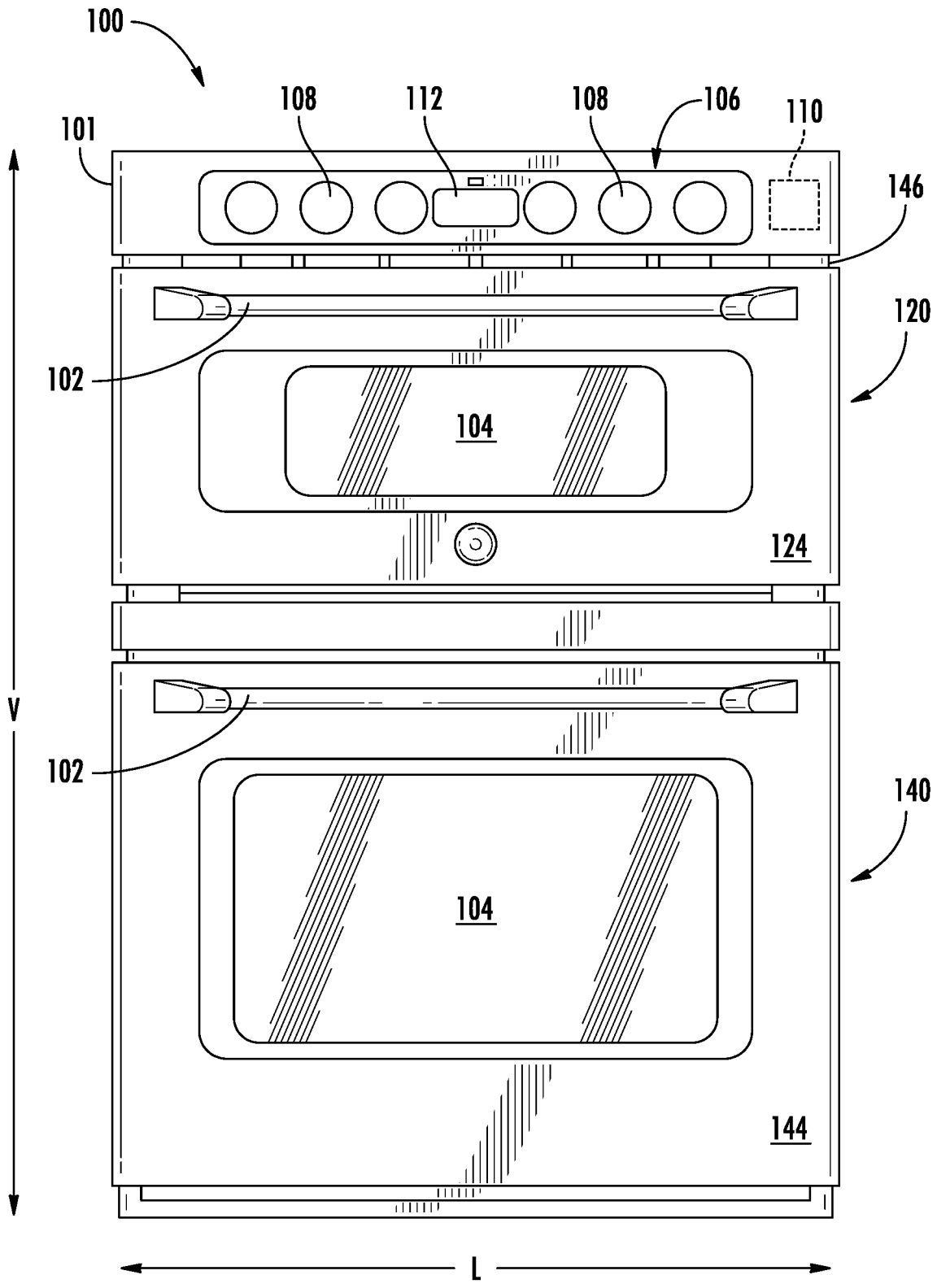
FIG. 1 provides an elevation view of an oven appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "coupled," "fixed," "attached to," and the like refer to both direct coupling, fixing, or attaching, as well as indirect coupling, fixing, or attaching through one or more intermediate components or features, unless otherwise specified herein.

As disclosed herein, a modular trim assembly may be provided to secure a cooking plate that can be directly cooked upon while covering or hiding a bottom heating assembly within an oven appliance.

Referring now to the drawings, FIG. 1 illustrates an exemplary embodiment of a double oven appliance 100 according to the present disclosure.

Although aspects of the present subject matter are described herein in the context of a double oven appliance 100, it should be appreciated that oven appliance 100 is provided by way of example only. Other oven or range appliances having different configurations, different appearances, or different features may also be utilized with the present subject matter as well (e.g., single ovens, electric cooktop ovens, induction cooktops ovens, etc.).

Generally, oven appliance 100 has a cabinet 101 that defines a vertical direction V, a longitudinal direction L and a transverse direction T. The vertical, longitudinal and transverse directions are mutually perpendicular and form an orthogonal direction system. In this regard, as used herein, the terms "cabinet," "housing," and the like are generally intended to refer to an outer frame or support structure for appliance 100, e.g., including any suitable number, type, and configuration of support structures formed from any suitable materials, such as a system of elongated support members, a plurality of interconnected panels, or some combination thereof. It should be appreciated that cabinet 101 does not necessarily require an enclosure and may simply include open structure supporting various elements of appliance 100. By contrast, cabinet 101 may enclose some or all portions of an interior of cabinet 101. It should be appreciated that cabinet 101 may have any suitable size, shape, and configuration while remaining within the scope of the present subject matter.

Double oven appliance 100 includes an upper oven 120 and a lower oven 140 positioned below upper oven 120 along the vertical direction V. Upper and lower ovens 120 and 140 include oven or cooking chambers 122 and 142, respectively, configured for the receipt of one or more food items to be cooked. Specifically, cabinet 101 defines a respective opening 123 for each cooking chamber 122 and 142. For instance, an upper opening 123 may be defined (e.g., along the transverse direction T) to access upper cooking chamber 122.

Double oven appliance 100 includes an upper door 124 and a lower door 144 in order to permit selective access to cooking chambers 122 and 142, respectively (e.g., via the corresponding opening). Handles 102 are mounted to upper and lower doors 124 and 144 to assist a user with opening and closing doors 124 and 144 in order to access cooking chambers 122 and 142. As an example, a user can pull on handle 102 mounted to upper door 124 to open or close upper door 124 and access cooking chamber 122. Glass window panes 104 provide for viewing the contents of cooking chambers 122 and 142 when doors 124, 144 are closed and also assist with insulating cooking chambers 122 and 142. Optionally, a seal or gasket (e.g., gasket 114) extends between each door 124, 144 and cabinet 101 (e.g., when the corresponding door 124 or 144 is in the closed position). Such gasket may assist with maintaining heat and cooking fumes within the corresponding cooking chamber 122 or 142 when the door 124 or 144 is in the closed position. Moreover, heating elements, such as electric resistance heating elements, gas burners, microwave elements, etc., are positioned within upper and lower oven 120 and 140.

A control panel 106 of double oven appliance 100 provides selections for user manipulation of the operation of double oven appliance 100. For example, a user can touch control panel 106 to trigger one of user inputs 108. In response to user manipulation of user inputs 108, various components of the double oven appliance 100 can be operated. Control panel 106 may also include a display 112, such as a digital display, operable to display various parameters (e.g., temperature, time, cooking cycle, etc.) of the double oven appliance 100.

Generally, oven appliance 100 may include a controller 110 in operative communication (e.g., operably coupled via a wired or wireless channel) with control panel 106. Control panel 106 of oven appliance 100 may be in communication with controller 110 via, for example, one or more signal lines or shared communication busses, and signals generated in controller 110 operate oven appliance 100 in response to user input via user input devices 108. Input/Output ("I/O") signals may be routed between controller 110 and various operational components of oven appliance 100 such that operation of oven appliance 100 can be regulated by controller 110.

Controller 110 is a "processing device" or "controller" and may be embodied as described herein. Controller 110 may include a memory and one or more microprocessors, microcontrollers, application-specific integrated circuits (ASICS), CPUs or the like, such as general or special purpose microprocessors operable to execute programming instructions or micro-control code associated with operation of oven appliance 100, and controller 110 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, controller 110 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Figure 2:
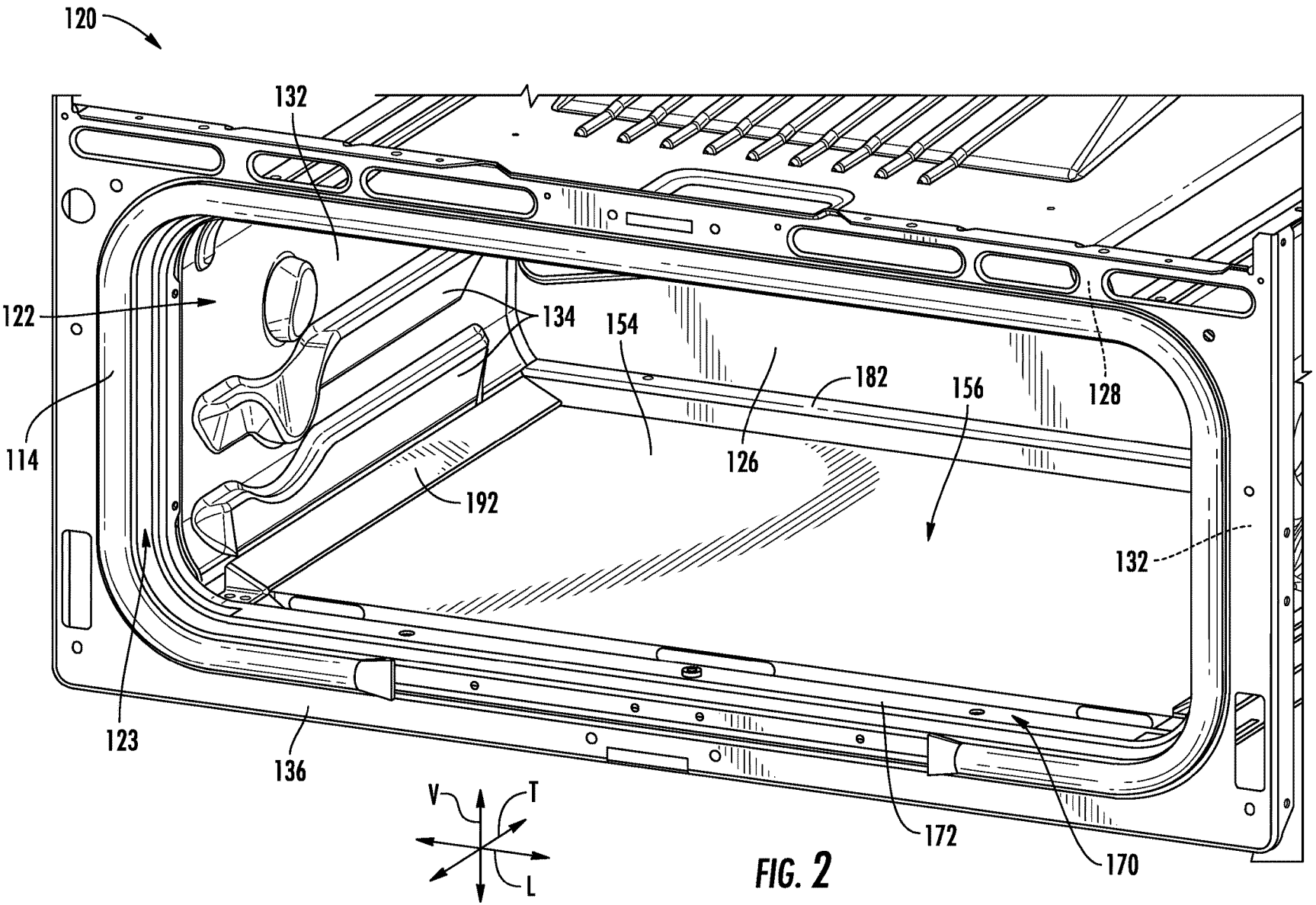
FIG. 2 provides a perspective view of an upper cooking chamber of the exemplary oven appliance of FIG. 1.
Figure 3:
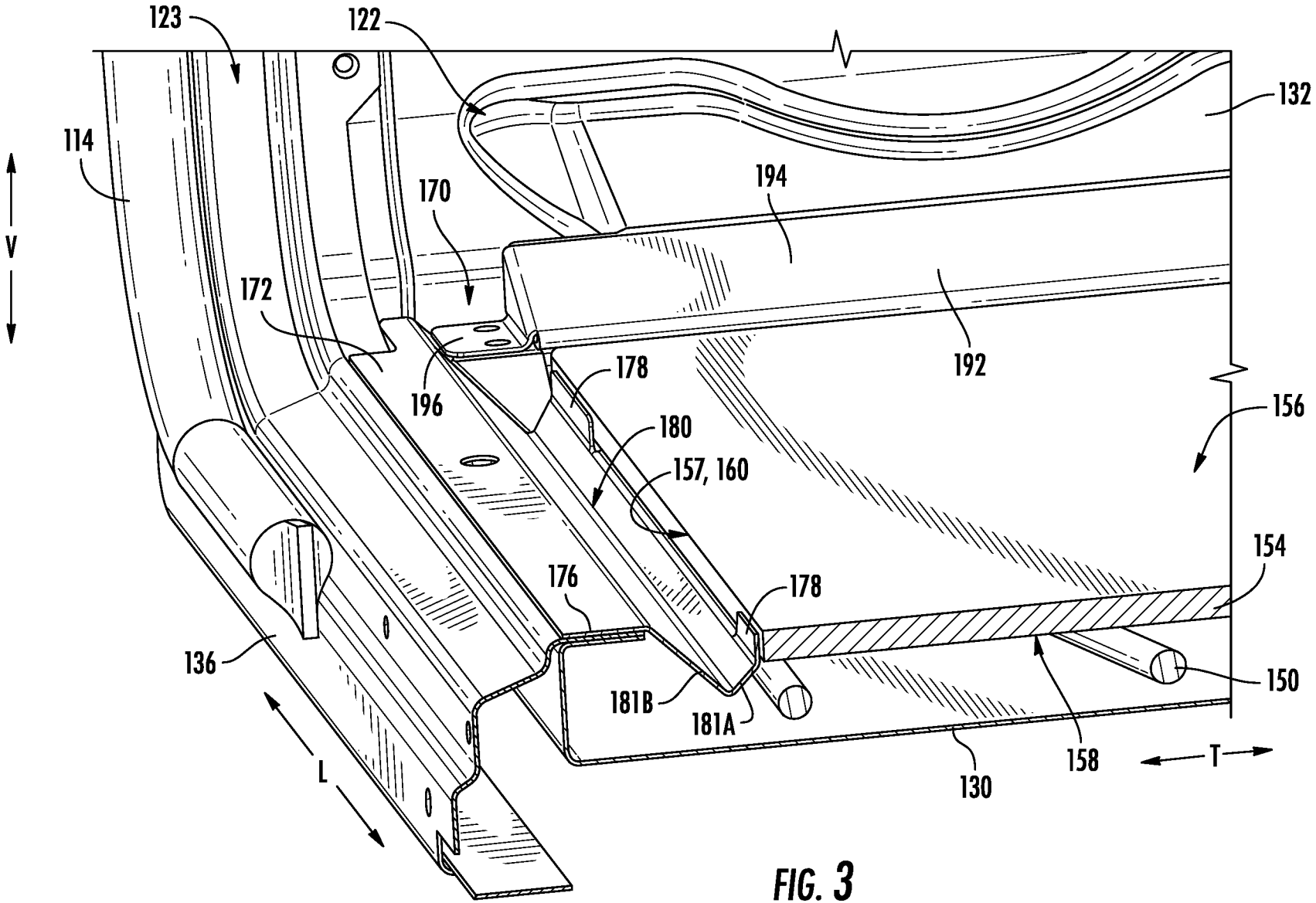
FIG. 3 provides a cross-sectional perspective view of the upper cooking chamber of the exemplary oven appliance of FIG. 1.
Figure 4:
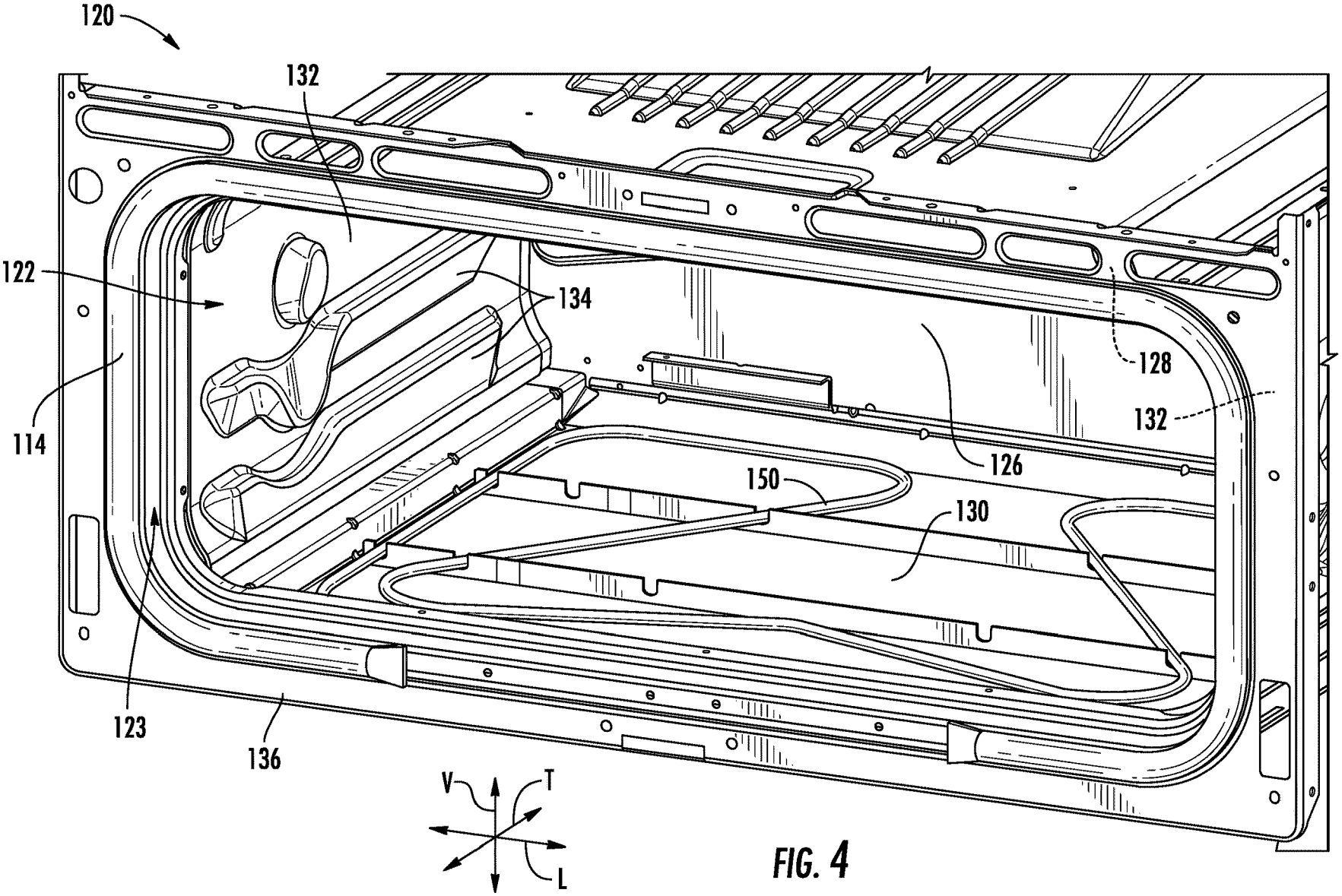
FIG. 4 provides another perspective view of the upper cooking chamber of the exemplary oven appliance of FIG. 1, wherein a cooking plate has been omitted for clarity.

Turning now to FIGS. 2 through 4, various views are provided illustrating, in particular, upper cooking chamber 122 of upper oven 120. As shown, upper cooking chamber 122 is generally defined by a back wall 126, a top wall 128 and a bottom wall 130 spaced from top wall 128 along the vertical direction V by opposing side walls 132 (e.g., a first wall and a second wall). Optionally, a front plate 136 may be attached to the walls to define the upper opening 123. For instance, front plate 136 may extend along bottom wall 130, top wall 128, and the opposing side walls 132 about upper opening 123. In turn, gasket 114 may be mounted on or engaged with front plate 136 (e.g., when the corresponding upper door is closed). In some embodiments opposing side walls 132 include embossed ribs 134 such that a baking rack containing food items may be slidably received onto embossed ribs 134 and may be moved into and out of upper cooking chamber 122 when door 124 is open. Optionally, such walls 126, 128, 130, 132 may be included within an outer casing 146 of cabinet 101, as is understood.

As shown, upper oven includes one or more heating elements to heat upper cooking chamber 122 (e.g., as directed by controller 110 as part of a cooking operation). For instance, a bottom heating element 150 may be mounted at a bottom portion of upper cooking chamber 122 (e.g., above bottom wall 130). Additionally or alternatively, a top heating element 152 may be mounted at a top portion of upper cooking chamber 122 (e.g., below top wall 128). Bottom heating element 150 and top heating element 152 may be used independently or simultaneously to heat upper cooking chamber 122, perform a baking or broil operation, perform a cleaning cycle, etc.

The heating elements 150, 152 may be provided as any suitable heater for generating heat within upper cooking chamber 122. For instance, either heating element may include an electric heating element (e.g., resistance wire elements, radiant heating element, electric tubular heater or CALROD®, halogen heating element, etc.). Additionally or alternatively, either heating element may include a gas burner.

Figure 7:
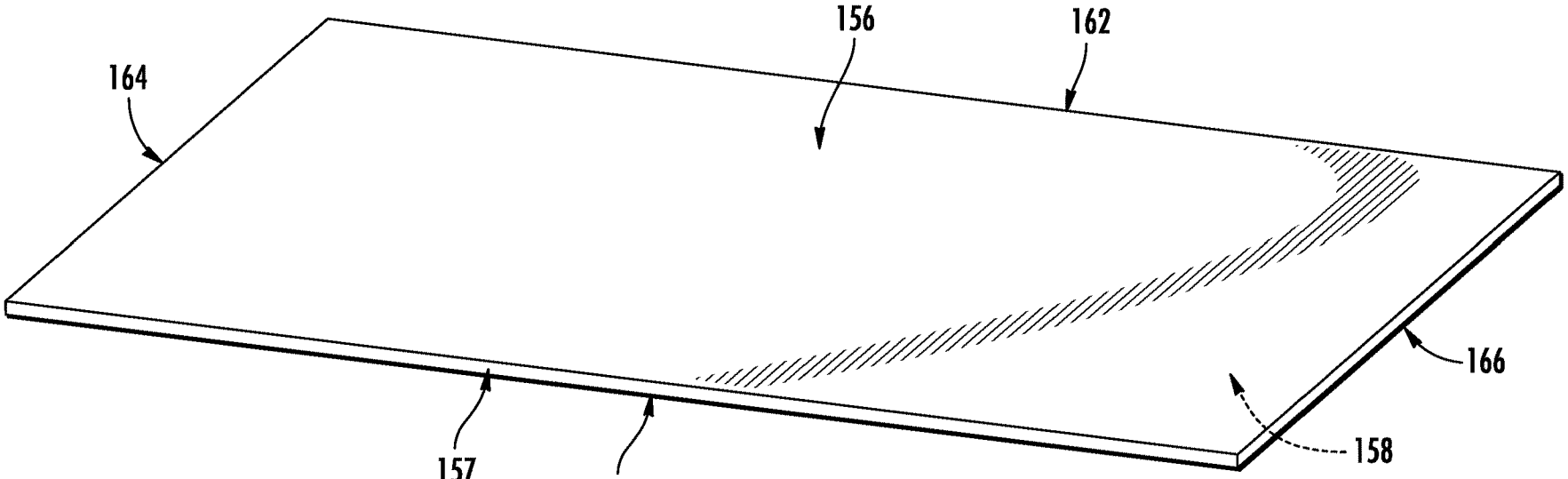
FIG. 7 provides a perspective view of a cooking plate, in isolation, of the exemplary oven appliance of FIG. 2.

Referring still to FIGS. 2 through 4, as well as FIG. 7, in some embodiments, a cooking plate 154 is provided within upper cooking chamber 122. Specifically, cooking plate 154 is disposed above bottom heating element 150 and may generally cover the same. Along with being disposed above bottom heating element 150, cooking plate 154 is disposed below top heating element and may be disposed below (e.g., at a lower vertical height than) each of the embossed ribs. In certain embodiments, cooking plate 154 is located at or near the same vertical height as the bottommost edge of upper opening 123. Thus, cooking plate 154 may generally be disposed proximal to the lower end of the cooking chamber 122.

When mounted within cooking chamber 122, cooking plate 154 extends along the transverse direction T between a front end 160 and a rear end 162, along the lateral direction L between a first lateral end 164 and a second lateral end 166, and along the vertical direction V between an upper cooking surface 156 and a lower surface 158. The cooking surface 156, in particular, is disposed between the bottom wall 130 and the top wall 128. Moreover, cooking surface 156 may be proximal to the bottom wall 130 and, thus, distal to the top wall 128. In some embodiments, cooking plate 154 is provided as a solid, nonpermeable member. Thus, food or fluids may be prevented from passing through cooking plate 154 (e.g., along the vertical direction V or perpendicular to cooking surface 156). In certain embodiments, cooking plate 154 includes or is formed from a conductive metal material, such as cast iron, steel, or aluminum (e.g., including alloys thereof). In additional or alternative embodiments, cooking plate 154 includes or is formed from a heat-retaining material, such as clay, stone (e.g., cordierite), ceramic, cast iron, or ceramic-coated carbon steel.

As shown, the cooking plate 154 may be disposed directly above (e.g., in vertical alignment with) the bottom heating element 150. Moreover, cooking plate 154 may define a horizontal footprint that spans across horizontal footprint of bottom heating element 150. In turn, cooking plate 154 may fully cover bottom heating element 150. When mounted within cooking chamber 122, cooking plate 154 may block or otherwise prevent access to bottom heating element 150, such as by a user reaching into the cooking chamber 122. Additionally or alternatively, the bottom heating element 150 may be held out of view such that a user is unable to see the bottom heating element 150. During use, heat generated at bottom heating element 150 may be directed upward to a lower surface 158 of cooking plate 154. As noted, bottom heating element 150 may be vertically aligned with (e.g., directly beneath) the cooking plate 154. The heat generated at bottom heating element 150 may thus be guided primarily or initially to the underside of cooking plate 154.

Turning now generally to FIGS. 3 through 7, in certain embodiments, cooking plate 154 is supported or held within cooking chamber 122, at least in part, by a modular trim assembly 170. As shown, the modular trim assembly 170 is disposed, at least in part, above the bottom heating element 150. Moreover, the modular trim assembly 170 includes multiple discrete pieces that may separately and independently engage cooking plate 154. For instance, the pieces of the modular trim assembly 170 may vertically hold cooking plate 154 (e.g., at a predetermined height) such that cooking plate 154 is spaced apart from bottom heating element 150 (e.g., not in contact therewith). Additionally or alternatively, modular trim assembly 170 may restrict horizontal movement of cooking plate 154 to ensure desired alignment relative to cooking chamber 122 or bottom heating element 150.

In some embodiments, the modular trim assembly 170 includes a debris trap 172 (e.g., provided as a front, side, or back trim). Generally, debris trap 172 defines a recessed trough 180 into which debris, such as crumbs or other small particles from cooking surface 156 may be collected. Specifically, recessed trough 180 provides a downward-extending void that is disposed below (e.g., at a lower height than) cooking surface 156. For instance, recessed trough 180 may be defined by two or more declined segments 181A, 181B, such as an outward-extending segment 181A and an inward-extending segment 181B. As shown, the outward-extending segment 181A generally descends (e.g., at a constant or variable angle) along a horizontal path outward, away from the cooking plate 154 or cooking chamber 122. The inward-extending segment 181B, by contrast, generally descends (e.g., at a constant or variable angle) along a horizontal path inward, further towards the cooking plate 154 or cooking chamber 122. The declined segments 181A, 181B may be joined together such that recessed trough 180 is vertically closed and prevents the passage of solids or fluids from passing therethrough (e.g., along the vertical direction V). In the illustrated embodiments, the declined segments 181A, 181B are joined together at a base (e.g., lowermost point) of the recessed trough 180.

As shown, recessed trough 180 may be horizontally spaced apart from cooking surface 156. Moreover, at least a portion of the debris trap 172 may be disposed above the cooking surface 156. For instance, the debris trap 172 may extend (e.g., along the transverse direction T) between a defined inner edge that is proximal to the mounted cooking plate 154 to a defined outer edge that is distal to the mounted cooking plate 154 and disposed above the cooking surface 156 (e.g., relative to the vertical direction V). Between the inner edge and the outer edge (e.g., along a horizontal direction, such as the transverse direction T), the recessed trough 180 may be uncovered or accessible, even while cooking plate 154 is mounted within cooking chamber 122. Advantageously, debris or particles on cooking surface 156 may be brushed or raked from (e.g., directly from) cooking surface 156 to recessed trough 180 without falling to bottom wall 130.

In the illustrated embodiments, debris trap 172 is mounted (e.g., removably or fixedly mounted) to cabinet 101 (e.g., at front plate 136). As shown, debris trap 172 may be provided as a front trim. Debris trap 172 may, in turn, be a mounted adjacent to the front portion of cooking chamber 122. Recessed trough 180 may be disposed between opening 123 and at least a portion of the cooking surface 156 along the transverse direction T. As shown, debris trap 172 may extend laterally (i.e., along the lateral direction L) along the opening 123. At least a portion of the lateral width of opening 123 may thus be spanned by debris trap 172. Nonetheless, debris trap 172 may be disposed, at least in part, below opening 123 such that opening 123 is not blocked or otherwise reduced in usable height by debris trap 172. The debris trap 172 may extend along the transverse direction T from the front plate 136 to the cooking plate 154. Additionally or alternatively, debris trap 172 may extend rearward (e.g., generally along the transverse direction T) from opening 123 or toward back wall 126. Optionally, debris trap 172 may be mounted or secured to front plate 136, such as by one or more suitable fasteners, welds, or adhesives.

Figure 5:
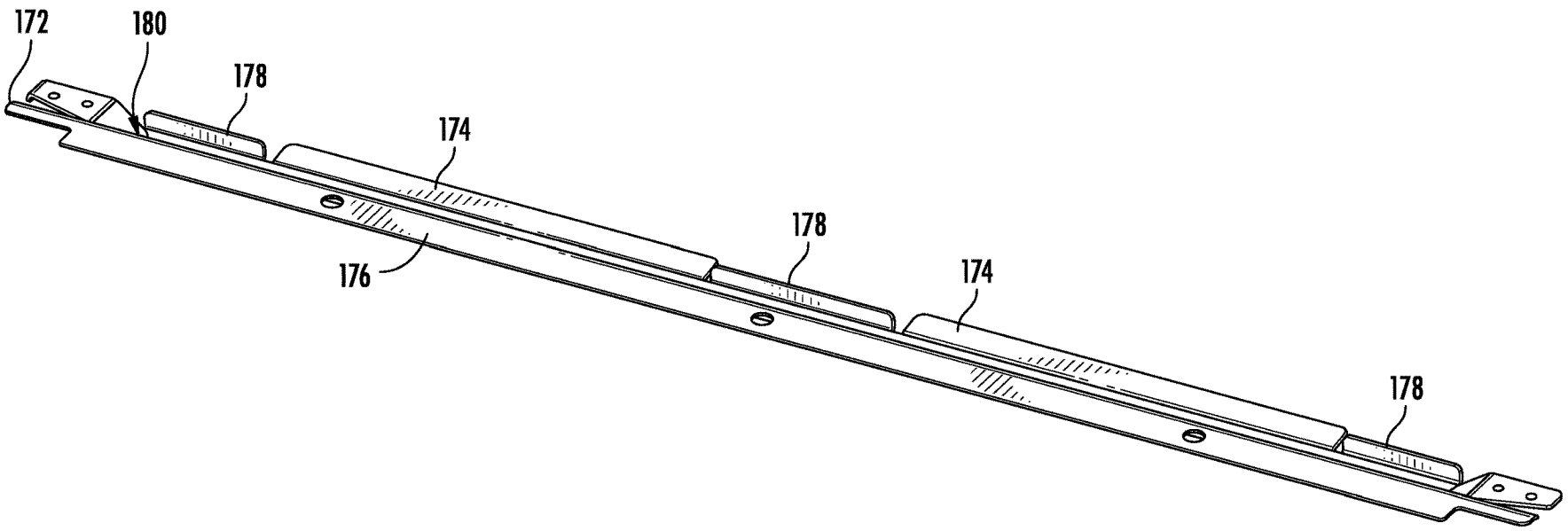
FIG. 5 provides a perspective view of a debris trap, in isolation, of the exemplary oven appliance of FIG. 2.

Turning especially to FIGS. 3 and 5, debris trap 172 may include an interior flange 174 to extend beneath the cooking plate 154. For instance, interior flange 174 may extend rearward from opening 123 along the transverse direction T. As shown, interior flange 174 may extend from a secured base 176. Secured base 176 may, as an example, contact or engage front plate 136 for support thereon. When mounted within cooking chamber 122, interior flange 174, in particular, may be disposed below (e.g., at a lower vertical height than) opening 123. In some embodiments, one or more vertical retainer tabs 178 each extends upward from interior flange 174. For instance, vertical retainer tab 178 may extend upward at a location inward from the recessed trough 180. The declined segments 181A, 181B may thus extend between the interior flange 174 and the secured base 176 (e.g., to connect the same). Moreover, relative to a horizontal direction, such as the transverse direction T, the vertical retainer tab(s) 178 may be spaced apart from secured base 176 (e.g., along the transverse direction T). Optionally, multiple vertical retainer tabs 178 may be spaced apart from each other (e.g., along the lateral direction L). Thus, interior flange 174 may be transversely and vertically offset from secured base 176.

As shown, cooking plate 154 may rest on top of debris trap 172. Specifically, the lower surface 158 may be supported on interior flange 174. In turn, interior flange 174 may limit downward vertical movement of cooking plate 154. The vertical retainer tab(s) 178 may be disposed against a peripheral edge 157 of cooking plate 154. For instance, vertical retainer tabs 178 may be disposed in front of and against the front end 160 of cooking plate 154, thereby restricting forward transverse movement of cooking plate 154.

Figure 6:
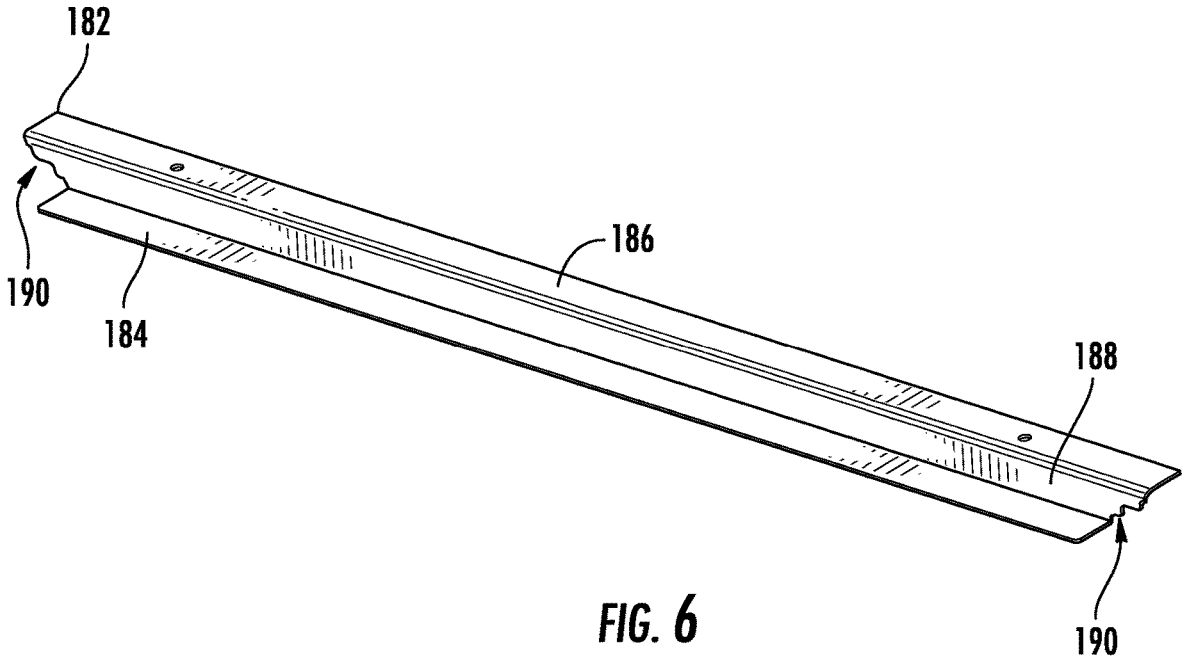
FIG. 6 provides a perspective view of a rear trim, in isolation, of the exemplary oven appliance of FIG. 2.

Turning especially to FIGS. 2 and 6, the modular trim assembly 170 includes a rear trim 182 mounted adjacent to the rear portion of cooking chamber 122. Specifically, rear trim 182 may extend laterally (i.e., along the lateral direction L) along the back wall 126. At least a portion of the lateral width of back wall 126 may thus be spanned by rear trim 182. Additionally or alternatively, rear trim 182 may extend forward (e.g., generally along the transverse direction T) from back wall 126 or toward opening 123. Optionally, rear trim 182 may be mounted or secured to back wall 126 (e.g., a lateral ridge thereon), such as by one or more suitable fasteners, welds, or adhesives.

In some embodiments, rear trim 182 includes a lower back flange 184 to extend beneath the cooking plate 154. For instance, lower back flange 184 may extend forward from back wall 126 along the transverse direction T. As shown, lower back flange 184 may extend from a secured back base 186. Secured back base 186 may, as an example, contact or engage a portion of back wall 126 for support thereon. When mounted within cooking chamber 122, lower back flange 184, in particular, may be disposed below (e.g., at a lower vertical height than opening 123). In some embodiments, a vertical back ridge 188 extends upward from lower back flange 184. As shown, vertical back ridge 188 may extend between or connect lower back flange 184 and secured back base 186. Thus, lower back flange 184 may be transversely and vertically offset from secured back base 186. In optional embodiments, rear trim 182 defines one or more one or more transverse channels 190 therethrough. For instance, between the secured back base 186 and the lower back flange 184, at least one transverse channel 190 may be defined through rear trim 182 along the transverse direction T. Optionally, a pair of discrete transverse channels 190 (i.e., a first transverse channel 190 and a second transverse channel 190) may be defined. Specifically, the transverse channels 190 may be spaced apart from each other along the lateral direction L. In some such embodiments, vertical back ridge 188 is disposed between the pair of transverse channels 190.

Generally, rear trim 182 may be spaced apart (e.g., rearward) from opening 123 or a front trim (e.g., debris trap 172). When mounted within cooking chamber 122, cooking plate 154 may rest on top of rear trim 182. Specifically, the lower surface 158 may be supported on lower back flange 184. In turn, lower back flange 184 may limit downward vertical movement of cooking plate 154. Vertical back ridge 188 may be disposed behind and against the rear end 162 of cooking plate 154, thereby restricting rearward transverse movement of cooking plate 154.

Turning especially to FIGS. 2 and 3, the modular trim assembly 170 includes one or more side trims 192 mounted adjacent to a corresponding side portion of cooking chamber 122. In some such embodiments, discrete, laterally spaced apart side trims 192 are positioned at each side wall 132. As would be understood, first and second side trims 192 may be formed as mirrored elements. Thus, it will be understood that the below discussion of a first side trim 192 mounted on first side wall 132 may also apply to a second side trim 192.

As shown, side trim 192 may extend laterally (i.e., along the lateral direction L) along the corresponding wall (e.g., first side wall 132). At least a portion of the transverse depth of the corresponding side wall 132 may thus be spanned by side trim 192. When assembled, side trim 192 may be disposed, at least in part, below opening 123. Additionally or alternatively, side trim 192 may extend inward (e.g., generally along the lateral direction L) from the corresponding side wall 132 or toward the opposite side wall 132. Optionally, side trim 192 may be mounted or secured to the corresponding back wall 126 (e.g., a transverse ridge thereon), such as by one or more suitable fasteners, welds, or adhesives. Additionally or alternatively, side trim 192 may be held relative to the back wall 126 (e.g., vertically or along the vertical direction V) via on or more indirect features. For instance, one or more side trim 192 may be held within or vertically constrained by a corresponding transverse channel 190 (e.g., defined by rear trim 182—FIG. 6). Thus, during assembly, the side trim 192 may be permitted to slide transversely into or through the corresponding transverse channel 190 without directly attaching to back wall 126.

In some embodiments, side trim 192 may include an upper side flange 194 to extend on (e.g., over or on top of) the cooking plate 154. For instance, upper side flange 194 may extend inward from the corresponding side wall 132 along the lateral direction L. As shown, upper side flange 194 may extend from one or more secured side bases 196 (e.g., in front of or behind upper side flange 194). A secured side base 196 may, as an example, contact or engage a portion of the corresponding side wall 132 for support thereon (e.g., a ridge formed on wall 132).

As shown, side trims 192 may extend between debris trap 172 and rear trim 182. Optionally, each side trim 192 may extend through a corresponding transverse channel 190. For instance, first side trim 192 may extend through a first transverse channel 190 while second side trim 192 extends through a second transverse channel 190. Thus, the side trims 192 may be held below at least a portion of rear trim 182. When mounted within cooking chamber 122, the side trims 192 may rest on cooking plate 154 (e.g., on cooking surface 156). Specifically, each upper side flange 194 may be supported on cooking surface 156. In turn, upper side flange 194 may limit upward vertical movement of cooking plate 154.

Advantageously, appliances or assemblies in accordance with the present disclosure may provide a secure cooking surface within a cooking chamber that is capable of withstanding high-heat operations (e.g., while hiding or protecting a bottom heating element within the oven appliance).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a vertical, a lateral, and a transverse direction, the oven appliance comprising:

a cabinet;

a door movably attached to the cabinet;

a plurality of chamber walls mounted within the cabinet, the plurality of chamber walls defining an oven chamber, the plurality of chamber walls comprising a back wall, a top wall, a first side wall, a second side wall, and a bottom wall;

a cooking plate defining a cooking surface in the oven chamber between the bottom wall and the top wall, the cooking plate being a solid, nonpermeable member preventing fluid passage therethrough;

a debris trap disposed against the cooking plate, the debris trap defining a recessed trough horizontally spaced apart from the cooking surface and disposed therebelow; and a bottom heating element mounted above the bottom wall to heat the cooking surface within the oven chamber, wherein the cabinet defines an opening selectively covered by the door and through which the oven chamber is accessible along the transverse direction, and wherein the recessed trough is disposed within the cabinet between the opening and the cooking surface along the transverse direction.

2. The oven appliance of claim 1, wherein the debris trap is attached to the cabinet.

3. The oven appliance of claim 1, wherein the debris trap comprises a pair of declined segments defining the recessed trough and joined at a base thereof.

4. The oven appliance of claim 1, wherein the cabinet comprises a front plate extending along the bottom wall, the top wall, the first side wall, and the second side wall, wherein the front plate defines the opening, and wherein the debris trap extends along the transverse direction from the front plate to the cooking plate.

5. The oven appliance of claim 1, wherein the debris trap comprises an interior flange supporting the cooking plate along the vertical direction.

6. The oven appliance of claim 1, wherein the debris trap comprises a vertical retainer tab disposed against a peripheral edge of cooking plate.

7. The oven appliance of claim 1, further comprising:

a first side trim extending transversely along the first side wall against the cooking plate, and a second side trim extending transversely along the second side wall against the cooking plate.

8. The oven appliance of claim 1, wherein the debris trap further defines an inner edge proximal to the cooking plate and an outer edge of the debris trap distal to the cooking plate, and wherein the outer edge of the debris trap is disposed above the cooking surface relative to the vertical direction.

9. An oven appliance defining a vertical, a lateral, and a transverse direction, the oven appliance comprising:

a cabinet;

a door movably attached to the cabinet;

a plurality of chamber walls mounted within the cabinet, the plurality of chamber walls defining an oven chamber, the plurality of chamber walls comprising a back wall, a top wall, a first side wall, a second side wall, and a bottom wall;

a cooking plate defining a cooking surface in the oven chamber between the bottom wall and the top wall, the cooking plate being a solid, nonpermeable member preventing fluid passage therethrough;

a debris trap disposed against the cooking plate, the debris trap defining a recessed trough horizontally spaced apart from the cooking surface and disposed therebelow, the debris trap further defining an outer edge disposed above the cooking surface relative to the vertical direction, the debris trap comprising an interior flange disposed beneath the cooking plate in support thereof; and a bottom heating element mounted above the bottom wall to heat the cooking surface within the oven chamber, wherein the cabinet defines an opening selectively covered by the door and through which the oven chamber is accessible along the transverse direction, and wherein the recessed trough is disposed within the cabinet between the opening and the cooking surface along the transverse direction.

10. The oven appliance of claim 9, wherein the debris trap is attached to the cabinet.

11. The oven appliance of claim 9, wherein the debris trap comprises a pair of declined segments defining the recessed trough and joined at a base thereof.

12. The oven appliance of claim 9, wherein the cabinet comprises a front plate extending along the bottom wall, the top wall, the first side wall, and the second side wall, wherein the front plate defines the opening, and wherein the debris trap extends along the transverse direction from the front plate to the cooking plate.

13. The oven appliance of claim 9, wherein the debris trap comprises a vertical retainer tab disposed against a peripheral edge of cooking plate.

14. The oven appliance of claim 9, further comprising:

a first side trim extending transversely along the first side wall against the cooking plate, and a second side trim extending transversely along the second side wall against the cooking plate.

15. An oven appliance defining a vertical, a lateral, and a transverse direction, the oven appliance comprising:

a cabinet;

a door movably attached to the cabinet;

a plurality of chamber walls mounted within the cabinet, the plurality of chamber walls defining an oven chamber, the plurality of chamber walls comprising a back wall, a top wall, a first side wall, a second side wall, and a bottom wall;

a cooking plate defining a cooking surface in the oven chamber between the bottom wall and the top wall;

a debris trap disposed against the cooking plate, the debris trap defining a recessed trough horizontally spaced apart from the cooking surface and disposed therebelow; and a bottom heating element mounted above the bottom wall to heat the cooking surface within the oven chamber, wherein the cabinet defines an opening selectively covered by the door and through which the oven chamber is accessible along the transverse direction, wherein the debris trap further defines an inner edge proximal to the cooking plate and an outer edge of the debris trap distal to the cooking plate, wherein the outer edge of the debris trap is disposed above the cooking surface relative to the vertical direction, and wherein the recessed trough is disposed within the cabinet between the opening and the cooking surface along the transverse direction.

16. The oven appliance of claim 15, wherein the cabinet comprises a front plate extending along the bottom wall, the top wall, the first side wall, and the second side wall, wherein the front plate defines the opening, and wherein the debris trap extends along the transverse direction from the front plate to the cooking plate.

17. The oven appliance of claim 15, wherein the debris trap comprises an interior flange supporting the cooking plate along the vertical direction.

18. The oven appliance of claim 15, wherein the debris trap comprises a vertical retainer tab disposed against a peripheral edge of cooking plate.

19. The oven appliance of claim 15, further comprising:

a first side trim extending transversely along the first side wall against the cooking plate, and a second side trim extending transversely along the second side wall against the cooking plate.

20. The oven appliance of claim 19, wherein the first side trim and the second side trim are disposed against the cooking surface to limit upward vertical movement of the cooking plate.

* * * * *